US011229249B2

(12) United States Patent
Nacion et al.

(10) Patent No.: US 11,229,249 B2
(45) Date of Patent: Jan. 25, 2022

(54) GLOVE WITH OPTIMIZED SAFETY MARKINGS

(71) Applicant: BRIGHTON-BEST INTERNATIONAL, INC., Long Beach, CA (US)

(72) Inventors: Markham Nacion, San Marcos, CA (US); Eric Matthew Jaeger, Southlake, TX (US); Philip Shawn Norfolk, McKinney, TX (US)

(73) Assignee: BRIGHTON-BEST INTERNATIONAL, INC., Long Beach, CA (US)

( * ) Notice: Subject to any disclaimer, the term of this patent is extended or adjusted under 35 U.S.C. 154(b) by 98 days.

(21) Appl. No.: 15/762,914

(22) PCT Filed: Sep. 23, 2016

(86) PCT No.: PCT/US2016/053459
§ 371 (c)(1),
(2) Date: Mar. 23, 2018

(87) PCT Pub. No.: WO2017/053809
PCT Pub. Date: Mar. 30, 2017

(65) Prior Publication Data

US 2018/0263317 A1 Sep. 20, 2018

Related U.S. Application Data

(60) Provisional application No. 62/257,376, filed on Nov. 19, 2015, provisional application No. 62/233,210, filed on Sep. 25, 2015.

(51) Int. Cl.
*A41D 19/015* (2006.01)
*A41D 19/00* (2006.01)

(52) U.S. Cl.
CPC ..... *A41D 19/015* (2013.01); *A41D 19/0157* (2013.01); *A41D 19/0051* (2013.01);
(Continued)

(58) Field of Classification Search
CPC ..... A41D 19/0157; A41D 2500/50; A41D 19/0051; A41D 13/01; A41D 19/015; A41D 2400/00; A41D 2600/20
(Continued)

(56) References Cited

U.S. PATENT DOCUMENTS 1,513,237 A * 10/1924 Green ..... G08B 5/004 359/517
1,630,730 A 5/1927 Daugherty
(Continued)

FOREIGN PATENT DOCUMENTS

CA 2632761 A1 11/2009
CN 204561045 U 8/2015
(Continued)

OTHER PUBLICATIONS https://www.amazon.com/Ringers-Gloves-Roughneck-Impact-Protection/dp/B01ID10HF0/ref=cm_cr_arp_d_product_top?ie=UTF8 (Year: 2014).*
(Continued)

*Primary Examiner* — Khoa D Huynh
*Assistant Examiner* — Uyen T Nguyen
(74) *Attorney, Agent, or Firm* — Mauriel Kapouytian Woods LLP; Benjamin Charkow

(57) ABSTRACT

A glove with optimized safety markings designed to improve worker safety in hazardous environments by increasing the visibility of the glove in the work environment and more easily distinguishing between the front and back of the glove. A preferred embodiment has fluorescent yellow hazard stripes, fluorescent yellow triangular safety
(Continued)

icon and black negative space within the safety icon, all on protective members. The protective members, black in color except for the fluorescent yellow portions, are attached to the glove back.

12 Claims, 5 Drawing Sheets

(52) U.S. Cl.
CPC ..... *A41D 2400/00* (2013.01); *A41D 2500/50* (2013.01); *A41D 2600/20* (2013.01)

(58) Field of Classification Search
USPC ..... 2/16, 161.6, 161.8; D29/113, 117.1; D2/615, 619; 359/517
See application file for complete search history.

(56) References Cited

U.S. PATENT DOCUMENTS

| | | | | |
|---|---|---|---|---|
| 1,966,822 | A | 7/1934 | Lieb | |
| D369,309 | S | 4/1996 | Marbach | |
| 5,898,942 | A | 5/1999 | Anderson | |
| 6,006,357 | A * | 12/1999 | Mead | A41D 19/0157 2/160 |
| 6,889,389 | B2 | 5/2005 | Kleinert | |
| 6,976,274 | B1 * | 12/2005 | Dufresne | A41D 19/01535 2/161.6 |
| 7,000,256 | B2 | 2/2006 | Kleinert | |
| 7,100,212 | B2 | 9/2006 | Jaeger | |
| D532,957 | S | 12/2006 | Hunter et al. | |
| 7,478,440 | B2 * | 1/2009 | Dolenak | A41D 19/01505 2/161.6 |
| D704,380 | S | 5/2014 | Kindler et al. | |
| D733,975 | S | 7/2015 | Mathota | |
| 9,854,859 | B2 * | 1/2018 | McEwen | A41D 19/00 |
| 2002/0096102 | A1 * | 7/2002 | Sloot | B60Q 7/005 116/63 P |
| 2002/0145864 | A1 * | 10/2002 | Spearing | A41D 13/01 362/103 |
| 2007/0076408 | A1 * | 4/2007 | Abas | G08B 5/006 362/103 |
| 2010/0071114 | A1 * | 3/2010 | Jaeger | A41D 19/01523 2/161.6 |
| 2010/0251453 | A1 * | 10/2010 | Chen | B60Q 1/2673 2/69 |
| 2012/0054937 | A1 * | 3/2012 | Robaire | A63B 71/148 2/16 |
| 2012/0159691 | A1 | 6/2012 | Phillippe et al. | |
| 2012/0227158 | A1 * | 9/2012 | Ashworth | A41D 19/0065 2/164 |
| 2014/0033392 | A1 * | 2/2014 | Bulan | A41D 19/01547 2/16 |
| 2015/0143599 | A1 * | 5/2015 | Binge | A63B 71/143 2/16 |
| 2016/0165978 | A1 * | 6/2016 | McEwen | A41D 19/0157 2/163 |

FOREIGN PATENT DOCUMENTS

| | | | | |
|---|---|---|---|---|
| DE | 1801520 | A1 * | 5/1970 | A41D 19/0157 |
| EP | 2014185 | A1 | 1/2009 | |
| EP | 2591688 | A1 | 5/2013 | |
| WO | 2007068981 | A2 | 6/2007 | |
| WO | 2015006835 | A1 | 1/2015 | |

OTHER PUBLICATIONS https://www.amazon.com/Aardvark-Reflective-Yield-symbol-Velcro/dp/B001GSKOU6 (Year: 2006).* https://www.amazon.com/Ringers-Gloves-Roughneck-Impact-Protection/dp/B01ID10HF0/ref=cm_cr_arp_d_product_top?ie=UTF8 (Year: 2014).*

National Intellectual Property Administration P.R. China, Notice of Action from the First Examination for Chinese Application 201680056098.X, 17 pp. (9 pp., 8 pp. English translation), Jun. 27, 2019.

European Patent Office, Extended European Search Report, issued in European Patent Application No. 16849756.8, 10 pp., dated Jun. 17, 2019.

Eystudios, 24/7 Reflective Traffic Gloves with Stop Sign, 2 pp., retrieved from the internet at www.emergencyresponderproducts.com/24etrgl.html on Aug. 27, 2015.

International Searching Authority (ISA), Notification of Transmittal of the International Search Report and the Written Opinion of the International Searching Authority, for International Application No. PCT/US16/53459, 19 pp., dated Feb. 3, 2017.

Atlantic Tactical, Traffic Safety—Hatch DayNite Reflective Gloves, 2 pp., retrieved from the internet at www.atlantictactical.com/hatch-daynite-reflective-gloves#.Vd9j5hRVikp on Aug. 27, 2015.

Ironclad Performance Wear Corp., IVE Ironclad Industrial Impact Gloves with Vibram Technology, 1 p., retrieved from the internet on Jan. 18, 2017 at www.youtube.com/watch?v=T7MpEuRskhY, Sep. 29, 2015.

Wuwei Police Equipment Co Ltd, Wuwei Gloves, 1 p., retrieved from the internet on Nov. 28, 2016 at web.archive.org/web/20150816023843/http://en.chinawuwei.comllisV?103_1,html, Aug. 16, 2015.

Mechanix Wear, ORHD Pinch-Point Protection, 3 pp., retrieved from the internet on Nov. 28, 2016 at web.archive.org/web/20150915024427/http://www.mechanix.com/safety/orhd, Sep. 15, 2015.

A.H. Wertheim, Visual conspicuity: A new simple standard, its reliability, validity and applicability, Ergonomics, Mar. 2010, vol. 53, No. 3, pp. 421-442, Taylor & Francis, United Kingdom.

Gary Lesley, Enhancing the daytime conspicuity of pedestrians through the usage of fluorescent materials, Color Research and Application, Apr. 1995, vol. 20, No. 2, pp. 117-123, John Wiley & Sons, New York, New York.

Australian Government, IP Australia, Examination Report No. 1 for Standard Patent Application for Australian Patent Application No. 2016327980, 4 pp., dated Mar. 2, 2021.

Directorate General of Intellectual Property, Substantive Examination Report Stage 1 for Indonesian Patent Application No. P00201802032, 3 pp. (2 pp., 1 p. English translation), dated Nov. 18, 2020.

* cited by examiner

GLOVE WITH OPTIMIZED SAFETY MARKINGS

CROSS-REFERENCE TO RELATED APPLICATIONS

This application claims the priority of and benefit to U.S. Provisional Patent Application No. 62/233,210, filed on Sep. 25, 2015, and U.S. Provisional Patent Application No. 62/257,376, filed on Nov. 19, 2016, the entire contents of which are incorporated by reference herein.

FIELD OF THE INVENTION

The present invention relates generally to gloves and more particularly to gloves with visual markings on the back of a glove designed to improve worker safety in hazardous environments by increasing the perception and recognition of the glove at a distance and making it easier to distinguish between the front and back of the glove.

BACKGROUND OF THE INVENTION

Workers in the oil and gas extraction industry often handle large pipes and heavy tools, such as steel wrenches. These items are typically handled in the presence of mud, crude oil, lubricating fluids such as a mixture of diesel fuel and mud, and other natural and synthetic lubricants. These lubricants assist in drilling for and extracting petrochemical compounds. The difficulty of gripping pipes and tools in the presence of lubricants creates a working environment susceptible to impacts occurring to the dorsal, or back, side of the hand. These impacts have historically resulted in a large number of hand injuries to workers.

In the field, operators of heavy equipment, such as cranes and the like, communicate with workers on the ground using hand signals. These hand signals are a vital method of communication. As part of that communication, it is important for the operators to see the workers' hands from distances that could be over 50 feet, such as 100 feet, and to also be able to distinguish between the front (palm) and back of the glove. Accordingly, gloves for use in the oil and gas extraction industry have been brightly colored to make them easier to see by the operators.

While most of the prior art gloves being used in the oil and gas industry are brightly colored, no glove to date has been designed that improves operator perception and recognition of a glove at a distance of about 50 feet or greater in an effort to lessen the frequency of recordable hand injuries.

SUMMARY OF THE INVENTION

A glove with patterns on the dorsal (back) side of the glove designed to improve perception and recognition at a distance is provided. The glove includes a safety icon consisting of a shape positioned in the central portion of the back of the glove. The safety icon may be in the shape of a polygon, circle, ellipse or other any other shape so long as it contains negative space within a portion of the inner area of the shape. A specific ratio of approximately 2:1 of the width of the negative space to the width of the surrounding safety icon has been found to improve perception of the safety icon at distances over 50 feet.

While the safety icon may have sharp edges, it is preferred that the safety icon have rounded edges. In view of the numerous horizontal and perpendicular lines present in the worker's environment such as from cranes, scaffolding, steel pipes, etc., a more rounded yet angular design of the safety icon makes the glove more recognizable from a distance. The negative space within the safety icon also makes the shape more recognizable. The safety icon is preferably a bright color, such as yellow, with added fluorescent dyes, which emit additional radiation in the visible spectrum, while the negative space is a dark color in contrast with the safety icon, preferably black. The area adjacent to and surrounding the safety icon is preferably a color which contrasts with the safety icon, more preferably black.

Pinched and fractured fingers are the two major sources of recordable hand injury in the oil and gas industry. In an effort to decrease the amount of these injuries, the glove includes the placement of stripes, preferably colored black and yellow, on each fingertip. Black and yellow hazard stripes are the generally accepted industry protocol for identifying physical hazards. Though the stripes are not being used to identify a specific hazard, utilizing these proven hazard stripes on each finger tip ensures that the finger tips will have increased visibility and be easily recognizable thus reducing the opportunity of recordable hand injury. The hazard stripes may also be other color combinations. For example for a glove being used in the fire industry, the hazard stripes may be red and white, which is the generally accepted industry standard for identifying items related to fire prevention.

In one embodiment, the safety icon and hazard stripes are encapsulated in a see-through composite material which eliminates fading and saturation which may occur when the brightly colored materials are exposed to the mud, crude oil or lubricants when working in the field.

In one embodiment the safety icon and hazard stripes are comprised of colors with added fluorescence.

In one embodiment the safety icon and hazard stripes are encapsulated in thermoplastic rubber.

It is anticipated and within the scope of this invention that the safety icon and hazard stripes may be applied directly to the back of a glove for industries where impact protection is not required. For applications where it is not essential to distinguish between the palm (front) and back of the glove, and the goal is only to make the hand recognizable at a distance, the safety icon may be placed on both the palm and back of the glove, with or without the inclusion of the hazard stripes.

It is anticipated and within the scope of the invention that the safety icon and hazard stripes may be applied to other hand coverings besides gloves, such as mittens.

These and other features of this invention are described in, or are apparent from, the following detailed description of various exemplary embodiments of this invention.

BRIEF DESCRIPTION OF THE DRAWINGS

Exemplary embodiments of this invention will be described with reference to the accompanying figures wherein.

DETAILED DESCRIPTION OF THE EXEMPLARY EMBODIMENTS

Figure 1:
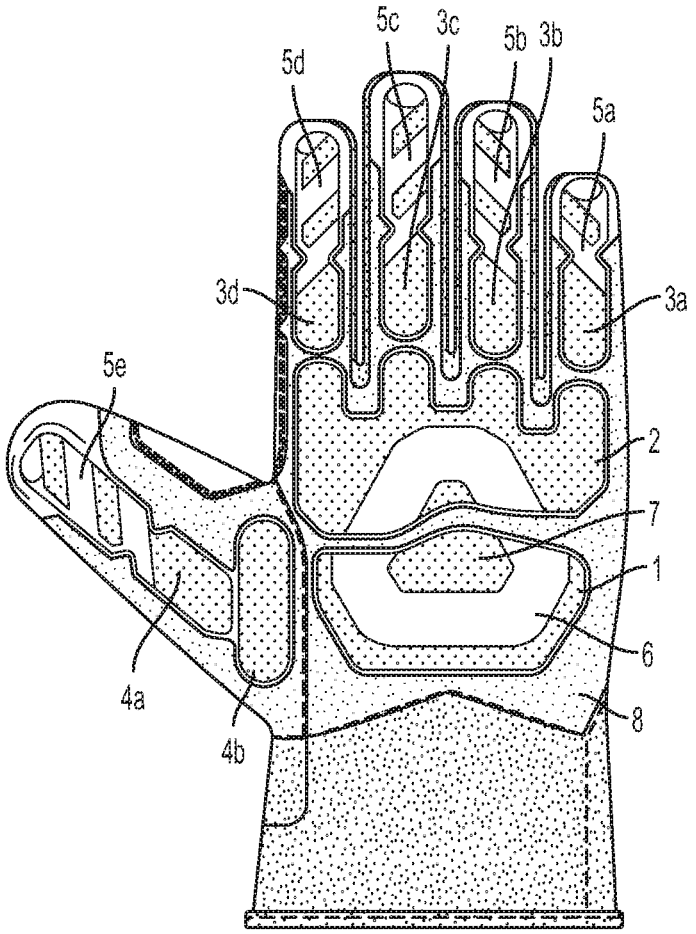
FIG. 1 is a top view of the back of a glove embodying the present invention illustrating a preferred embodiment where the safety icon is a triangular safety icon.

Initially referring to FIG. 1 the embodiment of the Glove With Optimized Safety Markings described herein includes a glove with protective members 1, 2, 3*a*-3*d*, 4*a*, 4*b* covering portions of the dorsal surface of the glove. Protective member 1 covers the metacarpal bones, protective member 2 covers the metacarpophalangeal joints, protective members 3*a*-3*d* cover the phalanges, and protective member 4*a* covers the thumb phalange and protective member 4*b* covers the first metacarpal portion of the thumb. Hazard stripes 5*a*-5*e* are positioned at the distal end of protective members 3*a*-3*d*, 4*a*. With the exception of hazard stripes 5*a*-5*e*, protective members 3*a*-3*d*, 4*a*, 4*b* are a dark color, preferably black. The hazard stripes are a contrasting bright color, preferably yellow, with added fluorescence. The use of yellow, consistent with industry standards and regulations (ANSI Z535, and OSHA regulations 1910.22 and 1920.144) which require the use of yellow to identify a physical hazard, will immediately signify to a worker wearing the glove or an operator moving materials near the glove, that care should be taken near the distal phalanges.

Protective members 1 and 2 have safety icon 6 positioned across both of these elements. In this embodiment, safety icon 6 is a triangular shape. With the exception of safety icon 6, protective members 1 and 2 are a dark color, preferably black. The safety icon is a contrasting bright color, preferably yellow, more preferably fluorescent yellow. Negative space 7 within safety icon 6 is a contrasting color to safety icon 6, preferably the same color as the remainder of protective members 1 and 2. In an embodiment such as this where safety icon 6 is positioned across protective members 1 and 2, there is a small gap in continuity of the safety icon corresponding to the space between the protective members necessary to allow adequate movement of the glove.

Glove fabric 8 is preferably a color that contrasts with both protective members 1, 2, 3*a*-3*d*, 4*a*, 4*b*, hazard stripes 5*a*-5*e*, safety icon 6, and negative space 7.

The protective members are preferably encapsulated in a polymeric covering to eliminate fading and saturation of the colors of the hazard stripes and triangular icon. More preferably, the polymer covering consists of thermoplastic rubber (TPR).

When a worker wears the glove, the worker and operator's attention is drawn to hazard stripes 5*a*-5*e*, bringing visibility to the distal phalanges and end of the thumb, making them instantly recognizable in order to minimize the potential for pinched and fractured fingers and a recordable hand injury.

When the worker wears the glove, the fluorescent colors of safety icon 6 and the contrasting black color of negative space 7 results in a shape more recognizable to the operator from a further distance. The palm of the glove is of a color different from hazard stripes 5*a*-5*e* or safety icon 6, preferably a bright color. The contrast between the back of the glove with visual markings and the palm of the glove, absent visual markings, assists the operator in recognizing the difference between the palm of the gloved hand and the back of the glove to improve the recognition of hand signals, particularly at a distance. In an embodiment where it is not important to distinguish between the palm and back of the glove, but recognition at a distance remains important, safety icon 6 may also be positioned on the palm portion of the glove.

Figure 2:
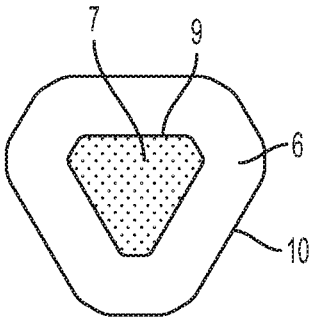
FIG. 2 is an illustration of the triangular safety icon of a preferred embodiment of the present invention.

FIG. 2 provides further detail as to safety icon 6 when shaped as a triangle. Triangular safety icon 6 comprises the area between inner triangle 9 and outer triangle 10 and negative space 7, which is contained within the area of inner triangle 9. Inner triangle 9 and outer triangle 10 are both equilateral triangles with rounded edges placed in the same orientation. The use of rounded edges in combination with the inner and outer triangles provides contrast to the numerous horizontal and perpendicular lines present in a worker's environment and makes the shape more easily recognizable at a distance to an operator who needs to see and distinguish between the palm and back of a worker's gloved hand. In an alternative embodiment (not shown), inner triangle 9 and outer triangle 10 of safety icon 6 may have sharp edges.

Figure 3:
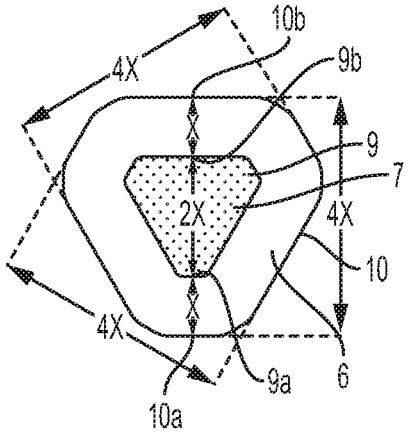
FIG. 3 is a detailed illustration of the triangular safety icon of a preferred embodiment of the present invention showing the required dimensional ratios of the safety icon, as applied to the triangular safety icon.

As illustrated in FIG. 3, safety icon 6 has unique dimensional characteristics designed to improve recognition at a distance. Safety icon 6 has a thickness of about x, which is shown for example in the distance between the vertex of inner triangle 9*a* and vertex of outer triangle 10*a*. With respect to inner triangle 9, the distance from midpoint 9*b* of one side of inner triangle 9 to the opposing vertex 9*a* is about 2x. With respect to outer triangle 10, the distance from midpoint 10*b* of one side of outer triangle 10 to the opposing vertex 10*a* is about 4x. This shape and ratio is designed to improve recognition at a distance of greater than about 50 feet.

Many variations may be made from the specific embodiment shown. For example, the color of hazard stripes 5*a*-5*e* and safety icon 6 may be any color, or differing colors, so long as the color chosen is in contrast to the respective protective members. In one specific embodiment, the glove back only contains safety icon 6 without hazard stripes 5*a*-5*e*.

The safety icon may also be any shape that fits within the central part of the back of the glove and contains the appropriate ratio proportion of negative space to enhance recognition at a distance of greater than about 50 feet. FIGS. 4-12 illustrate alternative embodiments of differing shapes.

Figure 4:
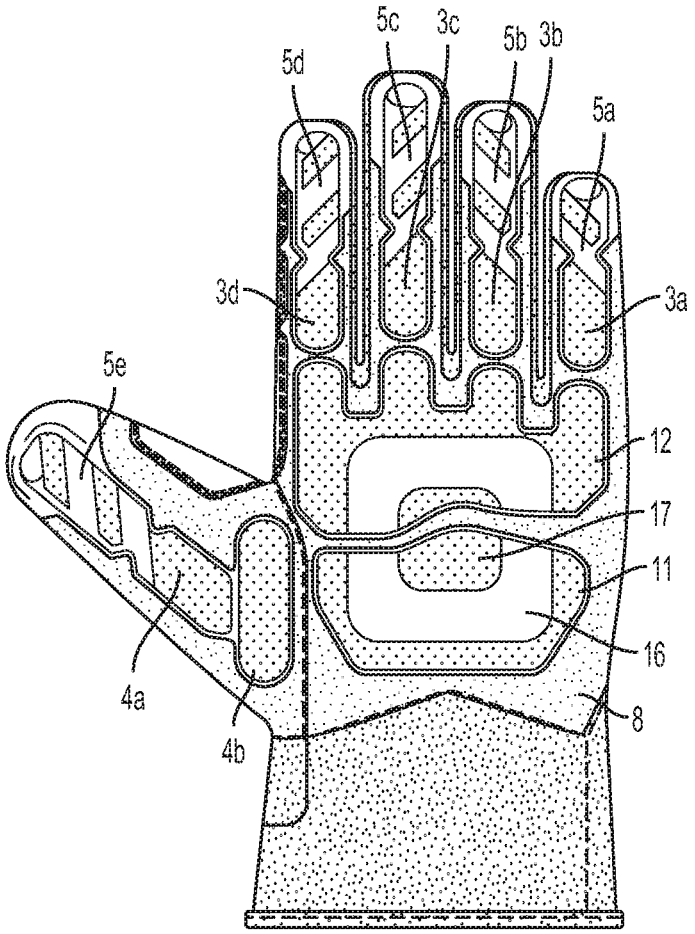
FIG. 4 is a top view of the back of a glove embodying the present invention illustrating an embodiment where the safety icon is a square safety icon.

FIG. 4 illustrates an embodiment of the Glove With Optimized Safety Markings wherein safety icon 16 is shaped as a square. Safety icon 16 overlays protective members 11 and 12 and has negative space 17. With the exception of safety icon 16, the remaining features of the dove presented by FIG. 4 are the same as those in FIG. 1. Accordingly, the same reference numbers are included with respect to these features in FIG. 4, except for protective members 11 and 12 which are in direct contact with safety icon 16.

Figure 5:
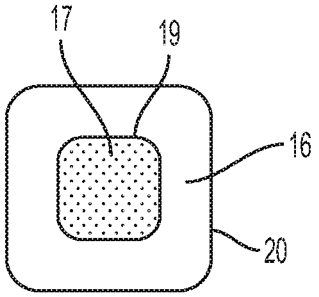
FIG. 5 is an illustration of the square safety icon of an embodiment of the present invention.

FIG. 5 provides further detail as to safety icon 16 when shaped as a square. Square safety icon 16 comprises the area between inner square 19 and outer square 20 and negative space 17, which is contained within the area of inner square 19. Inner square 19 and outer square 20 are both squares with rounded edges placed in the same orientation. The use of rounded edges in combination with the inner and outer squares provides contrast to the numerous horizontal and perpendicular lines present in a worker's environment and makes the shape more easily recognizable at a distance to an operator who needs to see and distinguish between the palm and back of a worker's gloved hand. In an alternative embodiment (not shown), inner square 19 and outer square 20 of safety icon 16 have sharp edges.

Figure 6:
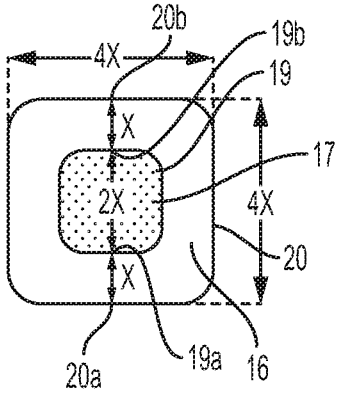
FIG. 6 is a detailed illustration of the square safety icon of an embodiment of the present invention showing the required dimensional ratios of the safety icon, as applied to the square safety icon.

As illustrated in FIG. 6, safety icon 16 has unique dimensional characteristics designed to improve recognition at a distance. Safety icon 16 has a thickness of about x, which is shown for example in the distance between the midpoint of a side of inner square 19*a* and the midpoint of the corresponding side of outer square 20*a*. With respect to inner square 19, the distance from midpoint 19*a* of one side of inner square 19 to the midpoint 19*b* of the opposing side of inner square 19 is about 2x. With respect to outer square 20, the distance from midpoint 20*a* of one side of outer square 20 to the midpoint 20*b* of the opposing side of outer square 20 is about 4x. This ratio of positive to negative space is designed to improve recognition at a distance of greater than about 50 feet.

Figure 7:
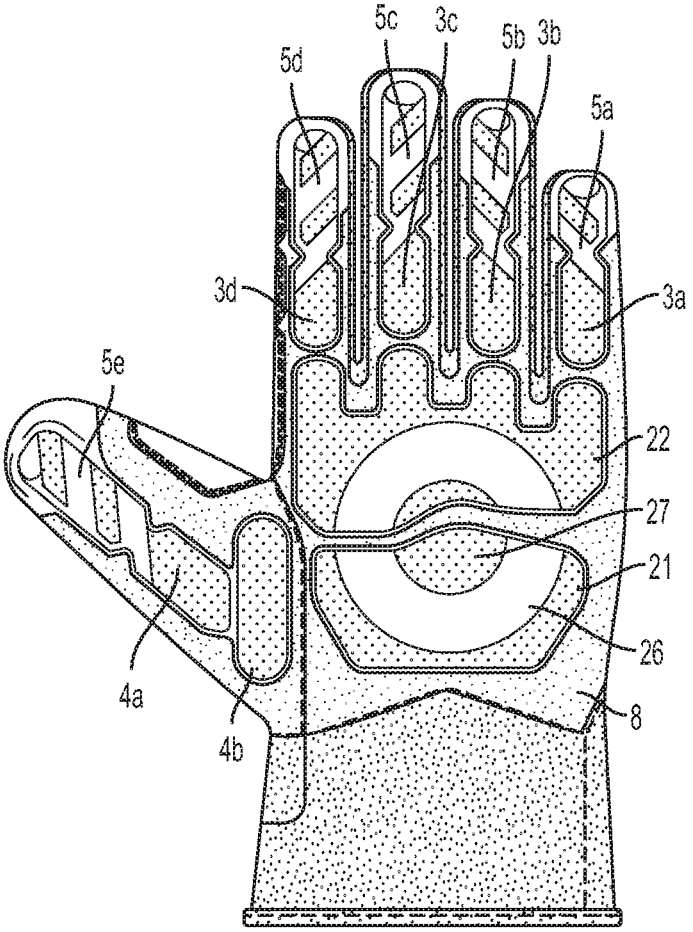
FIG. 7 is a top view of the back of a glove embodying the present invention illustrating an embodiment where the safety icon is a circular safety icon.

FIG. 7 illustrates an embodiment of the Glove With Optimized Safety Markings wherein safety icon 26 is shaped as a circle. Safety icon 26 overlays protective members 21 and 22 and has negative space 27. With the exception of safety icon 26, the remaining features of the glove presented by FIG. 7 are the same as those in FIG. 1, accordingly the same reference numbers are included with respect to these features in FIG. 7, except for protective members 21 and 22 which are in direct contact with safety icon 26.

Figure 8:
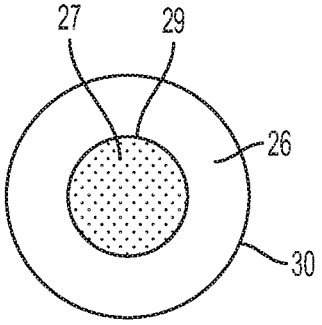
FIG. 8 is an illustration of the circular safety icon of an embodiment of the present invention.

FIG. 8 provides further detail as to safety icon 26 when shaped as a circle. Circular safety icon 26 comprises the area between inner circle 29 and outer circle 30 and negative space 27, which is contained within the area of inner circle 29. Inner circle 29 and outer circle 30 are concentric circles. The angular nature of the concentric circles contrast to the numerous horizontal and perpendicular lines present in a worker's environment and makes the shape more easily recognizable at a distance to an operator who needs to see and distinguish between the palm and back of a worker's gloved hand.

Figure 9:
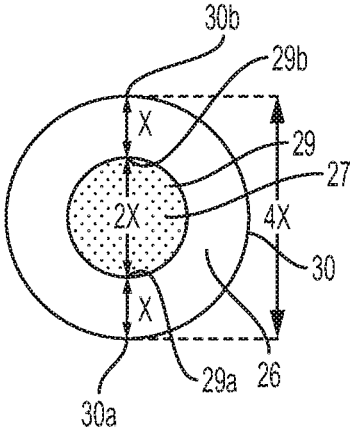
FIG. 9 is a detailed illustration of the circular safety icon of an embodiment of the present invention showing the required dimensional ratios of the safety icon, as applied to the circular safety icon.

As illustrated in FIG. 9, safety icon 26 has unique dimensional characteristics designed to improve recognition at a distance. Safety icon 26 has a thickness of about x, which is shown for example in the distance between the concentric inner and outer circles, shown on FIG. 9 as the distance between point 30*a* on outer circle 30 to point 29*a* on inner circle 29. The diameter of inner circle 29 is 2x, as indicated by the distance from point 29*a* and 29*b* on inner circle 29. The diameter of outer circle 30 is about 4x, as indicated by the distance between point 30*a* and 30*b* on outer circle 30. This ratio of positive to negative space is designed to improve recognition at a distance of greater than about 50 feet.

Figure 10:
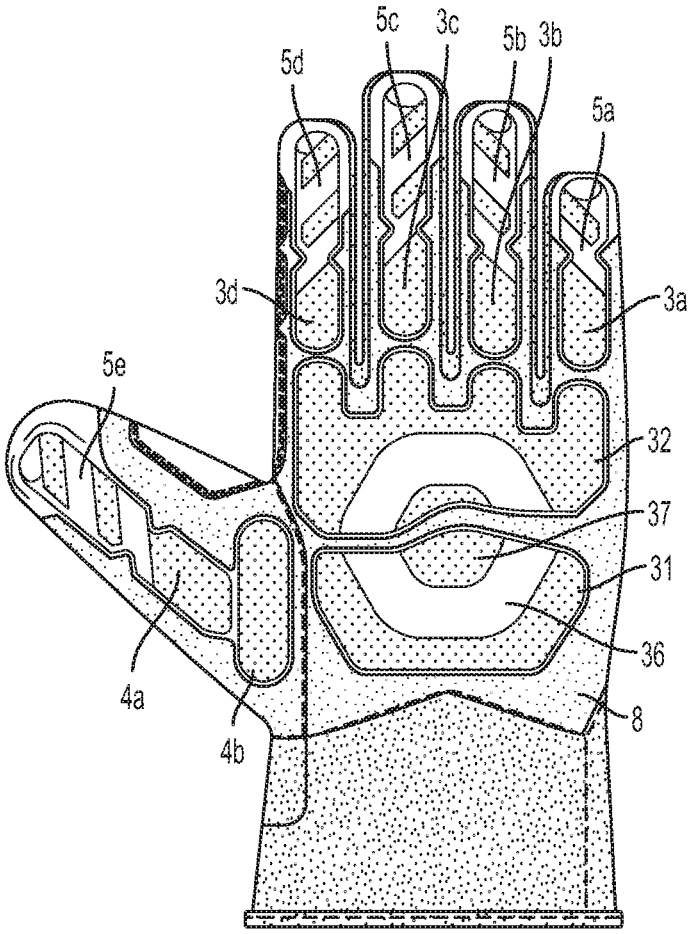
FIG. 10 is a top view of the back of a glove embodying the present invention illustrating an embodiment where the safety icon is a hexagonal safety icon.

FIG. 10 illustrates an embodiment of the Glove With Optimized Safety Markings wherein safety icon 36 is shaped as a hexagon. Safety icon 36 overlays protective members 31 and 32 and has negative space 37. With the exception of safety icon 36, the remaining features of the glove presented by FIG. 10 are the same as those in FIG. 1. Accordingly, the same reference numbers are included with respect to these features in FIG. 10, except for protective members 31 and 32 which are in direct contact with safety icon 36.

Figure 11:
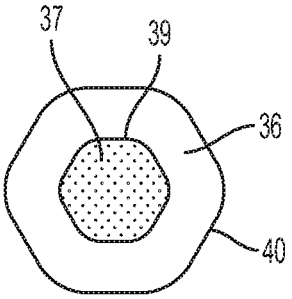
FIG. 11 is an illustration of the hexagonal safety icon of an embodiment of the present invention.

FIG. 11 provides further detail as to safety icon 36 when shaped as a hexagon. Hexagonal safety icon 36 comprises the area between inner hexagon 39 and outer hexagon 40 and negative space 37, which is contained within the area of inner hexagon 39. Inner hexagon 39 and outer hexagon 40 are both hexagons with rounded edges placed in the same orientation. The use of rounded edges in combination with the inner and outer triangles provides contrast to the numerous horizontal and perpendicular lines present in a worker's environment and makes the shape more easily recognizable at a distance to an operator who needs to see and distinguish between the palm and back of a worker's gloved hand. In an alternative embodiment (not shown), inner hexagon 39 and outer hexagon 40 of safety icon 36 have sharp edges.

Figure 12:
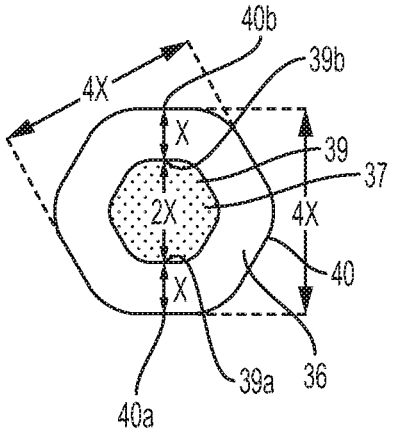
FIG. 12 is a detailed illustration of the hexagonal safety icon of an embodiment of the present invention showing the required dimensional ratios of the safety icon, as applied to the hexagonal safety icon.

As illustrated in FIG. 12, safety icon 36 has unique dimensional characteristics designed to improve recognition at a distance. Safety icon 36 has a thickness of about x, which is shown for example in the distance between the midpoint of a side of inner hexagon 39*a* and the midpoint of the corresponding side of outer hexagon 40*a*. With respect to inner hexagon 39, the distance from midpoint 39*a* of one side of inner hexagon 39 to the midpoint 39*b* of the opposing side of inner hexagon 39 is about 2x. With respect to outer hexagon 40, the distance from midpoint 40*a* of one side of outer hexagon 40 to the midpoint 40*b* of the opposing side of outer hexagon 40 is about 4x. This ratio of positive to negative space is designed to improve recognition at a distance of greater than about 50 feet.

In an embodiment for industries where visibility of the hand is important but the hand is not being exposed to physical hazards, safety icon 6, 16, 26 or 36 may be woven, printed, heat transferred, or otherwise directly applied onto the glove back with or without the presence of hazard stripes 5*a*-5*e*.

Test Methods

Conspicuity Testing

The relative conspicuity of the safety icon exemplified by the present invention in comparison to other possible safety icons was tested to evaluate improvement in recognition and perception of an icon embodied by the present invention when viewed at a typical jobsite for a glove wearer during daylight hours at a distance of 100 feet (i.e., more than 50 feet).

Figure 13C:
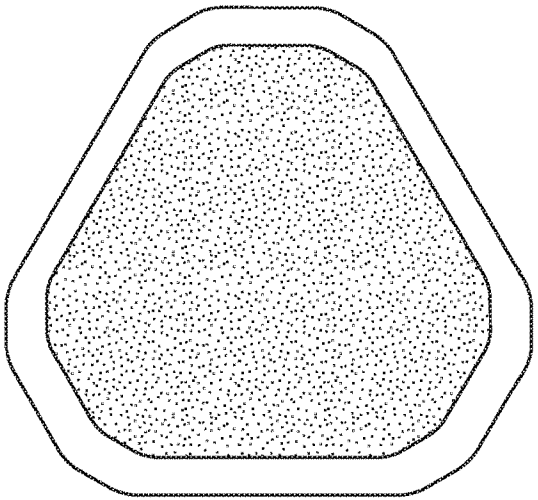
FIG. 13C exemplifies a triangular icon with a positive space thickness smaller than that of the safety icon of the present invention, used during conspicuity testing, referred to during the testing as the "thin" icon.
Figure 13B:
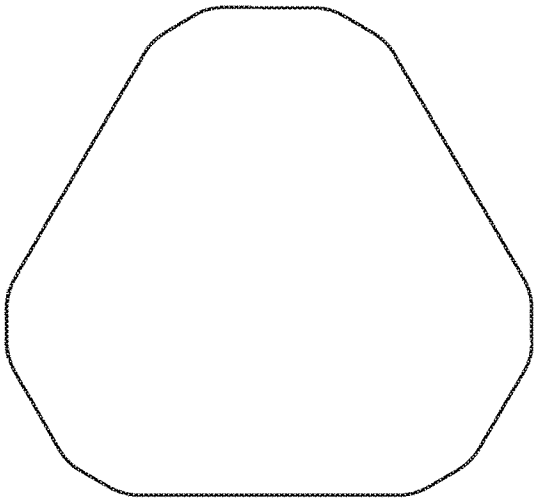
FIG. 13B exemplifies a triangular icon with no negative space used during conspicuity testing, referred to during the testing as the "solid" icon.
Figure 13A:
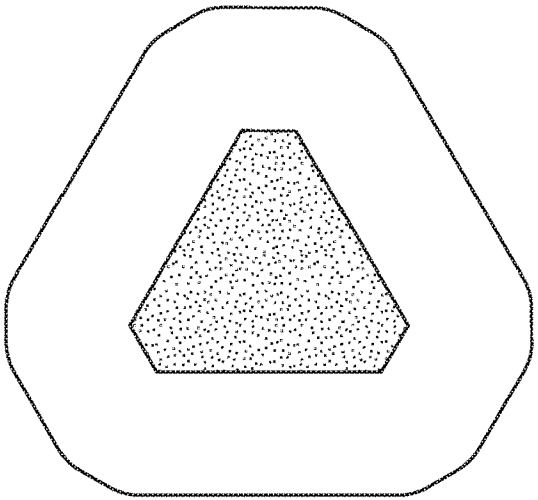
FIG. 13A, exemplifies the triangular embodiment of the present invention used during testing of the icon's relative conspicuity as compared with other designs (FIGS. 13B, 13C), and referred to during the testing as the "121" icon.

The conspicuity test compares the relative conspicuity of three icons (FIGS. 13A, 13B 13C), one of which, FIG. 13A, being a safety icon embodied by the present invention. The three icons are presented within the same exact scene and visual clutter, with each icon located in one of the same three locations to remove location bias from the data.

As part of the test, six test subjects evaluated one unique version of three images with the icons of FIGS. 13A, 13B, 13C placed on the test images. The test subjects each viewed one version of each test image and determined which icon was observed first. The images were displayed on a monitor screen at a decreased "real life" ratio of 5:1 approximately 20 feet from the test subjects. This 5:1 ratio in combination with the 20-foot distance between the test subject and the monitor simulated observation of the various icons at a distance of 100 feet.

As illustrated by FIG. 13, three icons were used for the conspicuity test.

FIG. 13A exemplifies the triangular safety icon of the present invention, specifically a safety icon with a specific ratio of approximately 2:1 of the width of the negative space to the width of the surrounding safety icon. This icon was referred to as the "121" icon during the test procedure and associated data recording.

FIG. 13B exemplifies a triangular safety icon with no negative space. This icon was referred to as the "solid" icon during the test procedure and associated data recording.

FIG. 13C exemplifies a triangular safety icon with a greater ratio of the width of negative space to the width of the surrounding icon. This icon was referred to as the "thin" icon during the test procedure and associated data recording.

Test Set Up

Three photographs representing expected work environments for wearers of gloves of the present invention were selected to be used as test images. For the conspicuity test, the following three test images were chosen: (1) a power transmission cable installation work crew; (2) a shale drilling rig (onshore); and (3) an offshore drilling platform. Each of these images contained both machinery and workers. It should be recognized by one of ordinary skill in the art that other images could be selected for this test.

Six versions of each test image were prepared. The three icons of FIGS. 13A, 13B, 13C were placed on each version of the test image in three discrete locations such that six versions of each test image were created. The icon locations were rotated on each image.

The icons used were sized to simulate a size, when being observed during the test, of about the actual size when placed on a glove of the present invention. For this test set-up, a 1080 pixel RCA monitor of dimensions 56.25 inches width and 31.5 inches height was used. The size of an individual in the test images when displayed on the monitor was 13.8 inches, approximately ⅕ of the actual height of the individual. Accordingly, an icon height of 14 mm was used, which is about ⅕ of the actual height of the icon when placed on a glove. A test subject standing 20 feet from an image of this size simulates standing 100 feet away from the image.

Test Subject Preparation

Each test subject was asked to stand 20 feet from the monitor displaying the images.

Each test subject was provided with the following information and instructions:

This will be a timed event.

One of the following three symbols, "121", "solid" or "thin" (represented by FIGS. 13A, 13B, 13C respectively) will be in the scene you are about to see on the monitor screen.

The scene will be a typical working jobsite. There will be machinery and workers.

The symbol will be near one of the people.

Indicate the moment the object is located and identify which object was located.

The identity of the object located will then be recorded as well as the time it takes to locate the object.

While each of the "121", "solid" and "thin." icons represented by FIGS. 13A, 13B, 13C were present in each image, the test subjects were not told that there would be more than one icon present in each test image.

Test Protocol

The monitor began with a blank screen. One of the six versions of test image 1 was presented on the monitor, in full screen format, to the test subject. Once the test subject located one icon, the monitor was switched to a blank screen. The length of time to find an icon was recorded and the icon that was found was recorded. If a test subject saw more than one icon in the test images, that identity of the second icon was also recorded.

The next test subject was then brought into the room and shown a different version of test image 1 and the same test was performed. The process was repeated using differing versions the same test image with the remaining five test subjects so that each test subject viewed one unique version of test image 1. The testing continued until each test subject viewed each of the six versions of test image 1.

The process was then repeated with the same six test subjects for the six versions of test image 2 and then for the six versions of test image 3.

Summary of Test Results

Table 1 below presents the conspicuity test data comparing the triangular safety icon of the present invention ("121", FIG. 13A) to other triangular icons ("solid", FIG. 13B; and "thin", FIG. 13C) as tested using the testing method described above.

TABLE 1

Conspicuity Test Data

| Image | Image Version | Test No | Test Subject | Icon Found 1st | Icon Found 2nd | Time (s) |
|---|---|---|---|---|---|---|
| 1 | 1 | 1 | 1 | 121 | Thin | 1.8 |
| 1 | 2 | 2 | 2 | 121 | — | 9.2 |
| 1 | 3 | 3 | 3 | 121 | — | 3.5 |
| 1 | 4 | 4 | 4 | Solid | — | 4.1 |
| 1 | 5 | 5 | 5 | 121 | — | 2.8 |
| 1 | 6 | 6 | 6 | Solid | — | 2.7 |
| 2 | 1 | 7 | 2 | 121 | — | 3.3 |
| 2 | 2 | 8 | 4 | 121 | — | 3.2 |
| 2 | 3 | 9 | 3 | 121 | — | 2.4 |
| 2 | 4 | 10 | 6 | Thin | 121 | 2.0 |
| 2 | 5 | 11 | 5 | Solid | — | 2.4 |
| 2 | 6 | 12 | 1 | Solid | 121 | 2.2 |
| 3 | 1 | 13 | 2 | 121 | Solid | 5.7 |
| 3 | 2 | 14 | 3 | Solid | — | 13.5 |
| 3 | 3 | 15 | 4 | Solid | — | 4.3 |
| 3 | 4 | 16 | 6 | Solid | Thin | 1.7 |
| 3 | 5 | 17 | 5 | Thin | — | 3.2 |
| 3 | 6 | 18 | 1 | 121 | — | 5.3 |

The analysis of the data in Table 1 is presented in Table 2 below:

TABLE 2

Analysis of Conspicuity Test Data

| | Times Icon Found First (Percentage) | | | |
|---|---|---|---|---|
| | 121 | Solid | Thin | Time (s) |
| Image 1 | 4 (67%) | 2 (33%) | 0 (0%) | 4.0 |
| Image 2 | 3 (50%) | 2 (33%) | 1 (17%) | 2.6 |
| Image 3 | 2 (33%) | 3 (50%) | 1 (17%) | 5.6 |
| Total | 9 (50%) | 7 (39%) | 2 (11%) | |

As seen in Table 2, the triangular safety icon of the present invention (the "121" icon embodied in FIG. 13A) was identified first in more instances than any of the other two test icons during the conspicuity testing, indicating that the safety icon of the present invention is more conspicuous than the other icons tested and should improve the worker's ability to see an individual wearing a glove with a safety icon embodied by the current invention at a distance of over 50 feet.

Now that embodiments of the present invention have been shown and described in detail, various modifications and improvements thereon will become readily apparent to those skilled in the art. Accordingly, the exemplary embodiments of the invention, as set forth above, are intended to be illustrative, not limiting. The spirit and scope of the present invention is to be construed broadly.

The invention claimed is:

1. A glove comprising:

a glove back;

a glove palm;

said glove palm joined to the glove back to form the glove, said glove having fingers and a thumb;

said glove back having a central portion corresponding to the portion of the glove back which is adapted to substantially cover the metacarpal bones and metacarpal joints of a hand;

a single triangular safety icon comprising the space between an outer equilateral triangle with rounded edges and an inner equilateral triangle with rounded edges with the same orientation and positioned within said central portion, the safety icon extending over at least half of the length and at least half of the width of the central portion, a negative space comprising the area within the inner equilateral triangle;

the negative space being of a first color which is a dark color;

said safety icon being of a second color which is a bright color that contrasts with the first color;

wherein the distance from the midpoint of each side of the inner equilateral triangle to the opposing vertex of the inner equilateral triangle is in a ratio of approximately two to one to the distance between the inner equilateral triangle and the outer equilateral triangle of the safety icon;

said safety icon surrounded by a remainder of the central portion, wherein at least an area adjacent to the safety icon is of a third color, said third color being a contrasting color to the second color.

2. The glove of claim 1, further comprising:

a finger protective member extending substantially along the length of each of the fingers of the glove back;

a thumb protective member extending substantially along the length of the thumb of the glove back; and hazard stripes on the distal ends of the finger protective members and the thumb protective member, said hazard stripes consisting of a fourth color that contrasts with the first color.

3. The glove of claim 2, further comprising:

a metacarpal bone protective member extending substantially over the central portion which is adapted to cover the metacarpal bones of the hand; and a metacarpal joint protective member extending substantially over the central portion which is adapted to cover the metacarpal joints of the hand;

said protective members being of a fifth color which contrasts with the second and fourth colors; and said safety icon extending over the metacarpal bone protective member and metacarpal joint protective member.

4. The glove of claim 3, wherein the hazard stripes consist of diagonal stripes aligned at an angle.

5. The glove of claim 1, wherein the third color is a shade darker than the second color.

6. The glove of claim 3, wherein the fourth color is a bright color and the third color and fifth color are shades darker than the second color and the fourth color.

7. The glove of claim 6, wherein the first color, the third color and the fifth color are the same color and the second and fourth colors are the same color.

8. A glove comprising:

a glove back;

a glove palm;

said glove palm joined to the glove back to form the glove, said glove having fingers and a thumb;

said glove back having a central portion corresponding to the portion of the glove back which is adapted to substantially cover the metacarpal bones and metacarpal joints of a hand;

a finger protective member extending substantially along the length of each of the fingers of the glove back;

a thumb protective member extending substantially along the length of the thumb of the glove back;

a metacarpal bone protective member extending substantially over the central portion which is adapted to cover the metacarpal bones of the hand;

a metacarpal joint protective member extending substantially over the central portion which is adapted to cover the metacarpal joints of the hand;

said protective members being of a first color which is a dark color;

a single triangular safety icon comprising the space between an outer equilateral triangle with rounded edges and an inner equilateral triangle with rounded edges with the same orientation and positioned within said central portion extending over the metacarpal bone protective member and the metacarpal joint protective member, a negative space comprising the area within the inner equilateral triangle;

the negative space being of the first color; and said safety icon being of a second color which is a bright color that contrasts with the first color;

wherein the distance from the midpoint of each side of the inner equilateral triangle to the opposing vertex of the inner equilateral triangle is in a ratio of approximately two to one to the distance between the inner equilateral triangle and the outer equilateral triangle of the safety icon.

9. The glove of claim 8, further comprising:

hazard stripes on the distal ends of the finger protective members and the thumb protective member, said hazard stripes consisting of a third color that contrasts with the first color.

10. The glove of claim 9, wherein the hazard stripes consist of diagonal stripes aligned at an angle.

11. The glove of claim 1, wherein the distance between the inner equilateral triangle and the outer equilateral triangle of the safety icon is about 17.5 mm.

12. The glove of claim 8, wherein the distance between the inner equilateral triangle and the outer equilateral triangle of the safety icon is about 17.5 mm.

* * * * *